US005256874A

United States Patent [19]

Chutjian

[11] Patent Number: 5,256,874

[45] Date of Patent: Oct. 26, 1993

[54] GRIDDED ELECTRON REVERSAL IONIZER

[75] Inventor: Ara Chutjian, La Crescenta, Calif.

[73] Assignee: California Institute of Technology, Pasadena, Calif.

[21] Appl. No.: 857,378

[22] Filed: Mar. 25, 1992

[51] Int. Cl.[5] ..... H01J 49/04

[52] U.S. Cl. ..... 250/288; 250/286; 315/111.91

[58] Field of Search ..... 250/288 R, 288 A, 289, 250/281, 282, 283, 286, 423 R; 315/111.81, 111.91

[56] References Cited

U.S. PATENT DOCUMENTS

| | | | |
|---|---|---|---|
| 4,755,669 | 7/1988 | Grant et al. | 250/288 |
| 4,782,235 | 11/1988 | Lejeune et al. | 250/423 R |
| 4,808,820 | 2/1989 | Blau | 250/281 |
| 4,810,878 | 3/1989 | Kobayashi | 250/288 |
| 4,933,551 | 6/1990 | Bernius et al. | 250/288 |

*Primary Examiner*—Jack I. Berman
*Assistant Examiner*—Jim Beyer
*Attorney, Agent, or Firm*—Norman E. Brunell

[57] ABSTRACT

A gridded electron reversal ionizer forms a three dimensional cloud of zero or near-zero energy electrons in a cavity within a filament structure surrounding a central electrode having holes through which the sample gas, at reduced pressure, enters an elongated reversal volume. The resultant negative ion stream is applied to a mass analyzer. The reduced electron and ion space-charge limitations of this configuration enhances detection sensitivity for material to be detected by electron attachment, such as narcotic and explosive vapors. Positive ions may be generated by generating electrons having a higher energy, sufficient to ionize the target gas and pulsing the grid negative to stop the electron flow and pulsing the extraction aperture positive to draw out the positive ions.

10 Claims, 1 Drawing Sheet

GRIDDED ELECTRON REVERSAL IONIZER

ORIGIN OF THE INVENTION

The invention described herein was made in the performance of work under a NASA contract, and is subject to the provisions of Public Law 96-517 (35 USC 202) in which the Contractor has elected to retain title.

BACKGROUND OF THE INVENTION

1. Field of the Invention

The present invention relates to techniques for the generation of negative ion beams, and in particular, to the generation of such ion beams by attachment of material to be detected to zero and near-zero velocity electrons. Such techniques are particularly useful for ultra-sensitive detection of vapors by molecular electron capture as used, for example, in the detection of concealed explosives or narcotic compounds.

2. Description of the Prior Art

Certain heavy molecules may be detected at very low vapor concentrations by the detection of negative ions produced by attachment with ultra low or zero energy electrons. As shown in U.S. Pat. No. 4,649,278 co-invented by the applicant hereof, near zero energy electrons produced by applying a beam of electrons from an electron gun to a mirror electrostatic field attach to molecules in a gas sample to form negative ions which may then be detected in accordance with their mass signatures by mass analysis.

An improved version is shown in U.S. Pat. No. 4,933,551, also co-invented by the applicant hereof, in which a relatively complex, high-current, in-line reversal electron ionizer capable of focusing a beam of electrons to a reversal region is used to produce zero and near-zero energy electrons for the production of detectable negative ions by attachment to certain heavy molecules in low vapor concentration.

The use of the Reversal Electron Attachment Detection—or READ—technique for detecting vapors from explosives and other compounds is well described in the literature, for example, in "Reversal Ion Source: A New Source of Negative Ion Beams", Orient, Chutjian and Alajajian, *Rev. Sci. Instrum.* 56 (1) Jan 85, pp 69-72; "Pulsed, High-Current, In-Line Reversal Electron Attachment Detector", Bernius and Chutjian, *J. Appl. Phys.* 66 (7) Oct. 1989, pp 2783-2787; and "Application of Reversal Electron Attachment for Ultra-Sensitive Detection of Thermal Electron-Attaching Molecules: $CC1_4$ and $C_6H_5N0_2$", Bernius and Chutjian, *Analytical Chemistry,* 62 (13) July 1990, pp 1345-1349.

As the techniques for detecting concealed narcotics or explosives compounds improve, however, so do the techniques for concealing such compounds. What are needed therefore are less complicated, more sensitive techniques which may readily be produced, deployed, maintained and serviced in many locations, such as airports, harbors, embassies, etc.

SUMMARY OF THE INVENTION

The preceding and other shortcomings of the prior art are addressed and overcome by the present invention that provides, in a first aspect, an electron reversal ionizer for detecting trace quantities of materials to be detected including hollow filament means having a central cavity for generating a cloud of electrons in said central cavity, an inlet for receiving a gas sample containing the material to be detected, central electrode means in said central cavity coupled to said inlet for applying the gas sample to the cavity, grid means for accelerating the cloud of electrons towards the central electrode means, means for controlling the potential of the central electrode means so that the cloud of electrons accelerated towards said central electrode means achieves zero and near-zero energy in an elongated reversal volume surrounding said central electrode means, and mass analyzer means for detecting negative ions created by attachment of the zero or near-zero energy electrons to the material to be detected.

The foregoing and additional features and advantages of this invention will become further apparent from the detailed description and accompanying drawing figures that follow. In the figures and written description, numerals indicate the various features of the invention, like numerals referring to like features throughout both the drawing figures and the written description.

DETAILED DESCRIPTION OF THE PREFERRED EMBODIMENT

Figure 1:
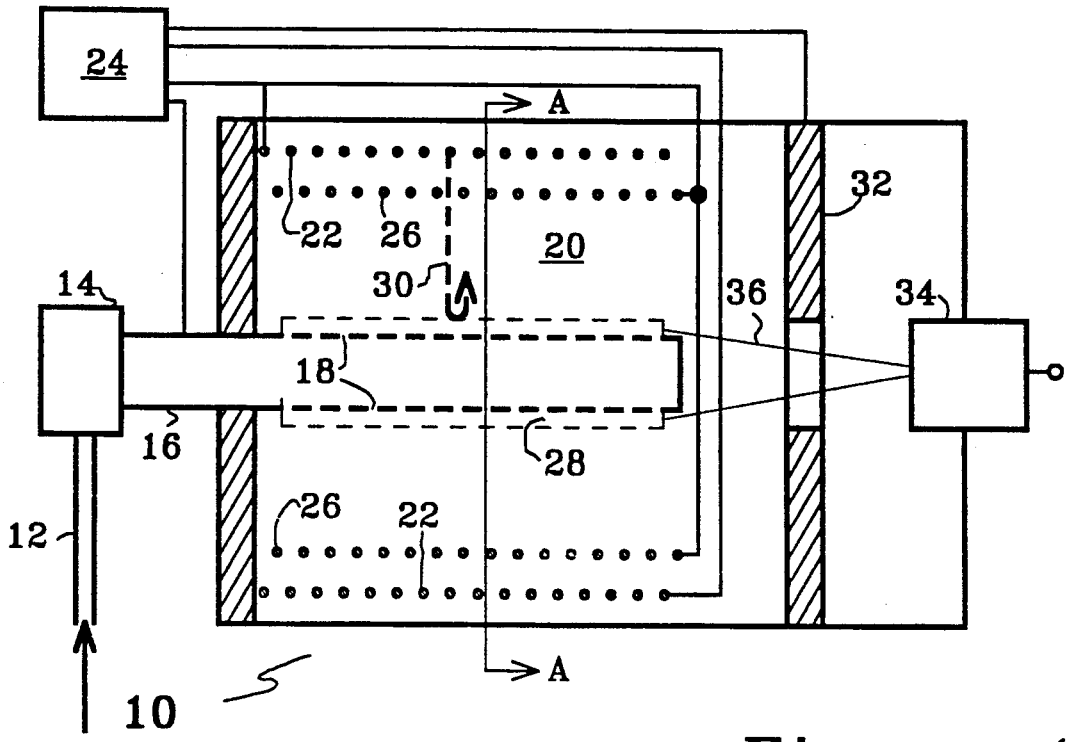
FIG. 1 is a cross-sectional view of a gridded electron reversal ionizer for the detection of trace concentrations of vapors of the certain compounds according to the present invention.

Referring now to FIG. 1, gridded electron reversal ionizer 10 includes atmospheric sample inlet 12 which accepts a gas sample at atmospheric pressure. The gas sample may contain minute traces of certain atoms or molecules, such as molecules of narcotics or explosive compounds, to be detected. The pressure of the gas sample is reduced in an atmospheric interface or trap 14, such as the rotary vapor trap available from Ion Track Instruments, Burlington, Mass.

Trap 14 functions by trapping onto a thin carbon film the heavier molecular weight species from an air stream directed over its surface from atmospheric sample inlet 12. The exposed area in trap 14 is then rotated into a vacuum region where the adsorbed species are heated and desorbed into a stream of argon gas. The argon carries the vapor containing the species of interest into central electrode 16. Trap 14 is then rotated again and heated to a high temperature during a cleanup step to desorb all species prior to the next exposure to atmospheric vapors. The range of operating pressures of the ionizer is from about $10^{-4}$ to about $10^{-7}$ torr. One of the advantages of the configuration of the present invention is that gas at higher pressures, near ambient pressures, may be sampled.

The gas sample containing the material to be detected is then provided to central electrode 16 which may conveniently be a perforated stainless steel tube of length of about 1.5", diameter of about 0.25" with on the order of about 100 holes drilled therein, each having a diameter of about 0.010". The material to be detected then flows through central electrode holes 18 of central electrode 16 into central chamber 20 of gridded electron reversal ionizer 10 with the relatively low kinetic energy typical of gases at room temperature.

At the same time, electrons are generated from filament 22 which may be any convenient source of electrons capable of high electron emissivity at the highest pressure in the device, e.g. $10^{-4}$ torr, and not contaminated by any of the trace species to be detected. One such electron source is as a thoriated iridium filament of the type used in a Bayard-Alpert ionization gauge available from Varian Associates of Palo Alto, Calif. as Model No. 0581-L5151-301 or from Granville-Phillips Corp. of Boulder, Colo. as Model No. 274025. The potential applied across filament 22 is controlled by instrument control system 24 to control the current of the cloud of electrons generated therefrom.

Gridded electron reversal ionizer 10 may be operated in a pulsed extraction operation, in which instrument control system 24 rapidly biases grid electrode 26 negative to prevent the electrons from reaching central electrode holes 18, while pulsing extraction aperture 32 positive to draw out all the negative ions formed near the surface of central electrode 16. The kinetic energy of the eleotrons near the surface of central electrode 16 is controlled by the potentials applied to grid electrode 26 and central electrode 16.

In addition, gridded electron reversal ionizer 10 may be operated in a continuous mode, but the electron energies and collision volume are less well defined in that operating mode.

Filament 22 may conveniently be formed into a hollow cylindrical shape as shown in FIG. 1, a hollow conical shape, or any other convenient shape enclosing a central cavity. The cylindrically-symmetric arrangement has the advantage that the potentials are more uniform. Filament 22 surrounds grid electrode 26 which may conveniently have the same shape, but a smaller diameter. The combination of filament 22 and grid electrode 26 surround central electrode 16.

The potentials of filament 22 and grid electrode 26 are controlled so that the cloud of electrons generated from filament 22 are accelerated by grid electrode 26 towards central electrode 16. The negative potential of central electrode 16 is controlled by instrument control system 24 so that, in elongated reversal volume 28 in the vicinity surrounding central electrode holes 18, the acceleration of such electrons is reduced to zero or near-zero velocity.

Figure 2:
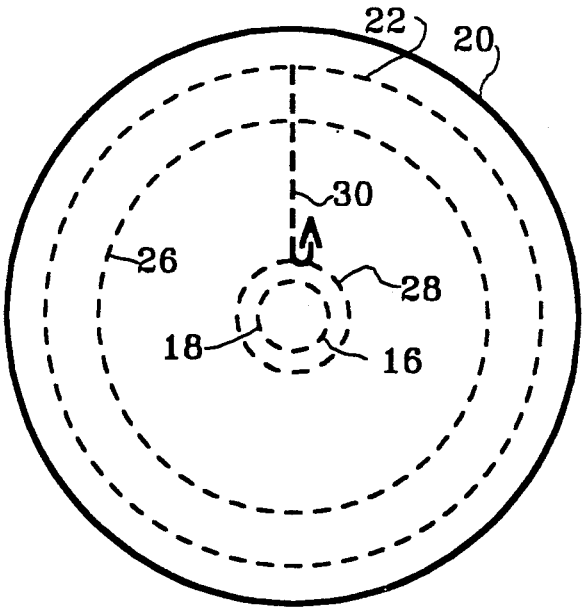
FIG. 2 is a cross-sectional view of gridded electron reversal ionizer 10, shown in FIG. 1, taken along line AA.

The path of a typical electron, shown as electron path 30, illustrates the path of the electrons in the electron cloud generated from filament 22. The arrowhead at the end of electron path 30 indicates the point in elongated reversal volume 28 at which the reverse potential from central electrode 16 has decelerated the electrons sufficiently to reduce their velocity to about zero. Electron path 30 may also be seen in FIG. 2 which is a cross-sectional view of gridded electron reversal ionizer 10 along line AA.

Elongated reversal volume 28 surrounds the portion of central electrode 16 including central electrode holes 18 so that the gas sample emerging from central electrode holes 18 encounters the zero or near-zero velocity electron cloud in elongated reversal volume 28. In elongated reversal volume 28, the zero or near-zero velocity electrons attach to form negative ions of thermal electron attaching molecules such as $CC1_4$, $C_6H_5N0_2$ and many species of explosives and narcotics. The negative ions may then be analyzed, as described below, to detect and measure the presence of many different materials at their very low concentrations.

Once the negative ions have been formed by attachment of zero or near-zero energy electrons to molecules from the gas sample emerging from central electrode holes 18, the cloud of negative ions is extracted toward focussing aperture 32 and focused through a central opening in extraction aperture 32 onto the entrance plane of a mass analyzer, such as magnetic or quadrupole mass analyzer 34. The path of the negative ion cloud from elongated reversal volume 28 through extraction aperture 32 to mass analyzer 34 is generally indicated in FIG. 1 as ion path 36.

It may be convenient to extract the negative ions by means of a pulsing operation as described for example in U.S. Pat. No. 4,933,551, Bernius and Chutjian, or as shown in FIG. 1 by controlling the potential of extraction aperture 32 with instrument control system 24 to accelerate the negative ion cloud toward mass analyzer 34 through the opening in extraction aperture 32. In other embodiments, the negative ion cloud may be extracted at least in part by fringing field effects.

The configuration of the present invention has substantial advantages over the known prior art. In particular, gridded electron reversal ionizer 10 has substantially higher sensitivity, due in part to the increased volume in which the attachment may take place between zero or near-zero energy electrons and the molecules to be detected. In conventional systems, a stream of electrons is reduced to zero or near-zero energy at a relatively small point at which the sample gas containing the material to be detected is applied. Another advantage of this configuration is the ability to operate at higher gas sample pressures, closer to ambient pressure, and hence to realize greater sample throughput.

In accordance with the present invention, the three dimensional volume or cloud of electrons filling the interior of the cylindrical volume encompassed by the filament and grid, is brought to zero or near-zero energy in elongated reversal volume 28 surrounding central electrode holes 18. Elongated reversal volume 28 provides the physical room necessary to reduce any space charge effects caused by the interaction between and/or among charged ions and electrons in the attachment process. This may otherwise occur in a conventional system in which the sample gas impinges on a stream of electrons, forming a small interaction volume; rather than having the cloud of electrons and the resultant negative ions extend along the sample gas in the larger volume of elongated reversal volume 28.

In addition to generating negative ions, the device of the present invention may also be used to generate positive ions. Positive ions have applications in many areas of research and development, such as basic atomic and molecular collision physics and chemistry, ion-beam lithography, surface analysis, etc. In order to generate positive ions, instrument control system 24 applies a potential to grid electrode 26 to generate higher energy electrons in elongated reversal volume 28 to ionize the target gas. Thereafter, a pulsed negative potential is applied on grid electrode 26 to stop the electron flow and a positive pulsed potential is then applied to extraction aperture 32 to draw out the positive ions from the ionized target gas. The potentials in mass analyzer 34 would be selected or adjusted to accommodate the opposite sign of the particle charge.

While this invention has been described with reference to its presently preferred embodiments, its scope is not limited thereto. Rather, such scope is only limited in so far as defined by the following set of claims and includes all equivalents thereof.

What is claimed is:

1. An electron reversal ionizer for detecting trace quantities of materials to be detected, comprising:

hollow filament means having a central cavity for generating a cloud of electrons in said central cavity;

an inlet for receiving a gas sample containing the material to be detected;

central electrode means in said central cavity, coupled to said inlet, for applying the gas sample to the cavity;

grid means for accelerating the cloud of electrons towards the central electrode means;

means for controlling the potential of the central electrode means so that the cloud of electrons accelerated towards said central electrode means achieves zero and near-zero energy in an elongated reversal volume surrounding said central electrode means; and mass analyzer means for detecting ions created by attachment of the zero and near-zero energy electrons to the material to be detected.

2. The electron reversal ionizer claimed in claim 1 wherein the hollow filament means further comprises:

a filament formed in a hollow cylindrical structure surrounding the central electrode means.

3. The electron reversal ionizer claimed in claim 2 wherein the grid means further comprises:

a hollow cylindrical structure formed within the cylindrical structure of the filament means.

4. The electron reversal ionizer claimed in claim 1 wherein the hollow filament means further comprises:

a filament formed in a hollow conical structure surrounding the central electrode means.

5. The electron reversal ionizer claimed in claim 4 wherein the grid means further comprises:

a hollow conical structure formed within the conical structure of the filament means.

6. The electron reversal ionizer claimed in claim 1, wherein the mass analyzing means further comprises:

means for extracting the ions from the elongated reversal volume.

7. The electron reversal ionizer claimed in claim 6 wherein the means for extracting further comprises:

focussing electrode means having an aperture positioned between the central electrode means and the mass analyzing means; and means for controlling the potential of the focussing electrode means to accelerate the ions from the central electrode towards the aperture in the focussing electrode means.

8. The electron reversal ionizer claimed in claim 7 wherein the means for extracting further comprises:

means for controlling the potential of the grid means to stop acceleration of the cloud of electrons towards the central cavity electrode.

9. The electron reversal ionizer claimed in claim 7 wherein the ions are negative ions.

10. The electron reversal ionizer claimed in claim 7 wherein the ions are positive ions.

* * * * *